US005735724A

United States Patent [19]

Udagawa

[11] Patent Number: 5,735,724

[45] Date of Patent: Apr. 7, 1998

[54] TOY ASSEMBLY HAVING MOVING TOY ELEMENTS

[75] Inventor: Kazuhiko Udagawa, Tokyo, Japan

[73] Assignee: Dah Yang Toy Industrial Co., Ltd., Tainan, Taiwan

[21] Appl. No.: 787,704

[22] Filed: Jan. 24, 1997

[51] Int. Cl.[6] ..... A63H 29/08; G09F 19/02

[52] U.S. Cl. ..... 446/172; 446/171; 40/409; 40/430

[58] Field of Search ..... 446/168, 171, 446/172, 173, 489, 246; 40/409, 411, 429, 430

[56] References Cited

U.S. PATENT DOCUMENTS

| | | | |
|---|---|---|---|
| 1,615,342 | 1/1927 | Nelson | 446/172 |
| 3,782,729 | 1/1974 | Ernst | 40/409 |
| 3,905,140 | 9/1975 | Damiano | 446/409 |
| 4,118,886 | 10/1978 | Bartoo | 446/489 |
| 5,136,799 | 8/1992 | Knappick et al. | 40/505 |

*Primary Examiner*—Robert A. Hafer
*Assistant Examiner*—Laura Fossum
*Attorney, Agent, or Firm*—Morgan, Lewis & Bockius LLP

[57] ABSTRACT

A toy assembly is provided with manual and electrical operation units which can be selectively actuated to rotate a shaft, which has a helical advancing path, in one direction in an ascending chamber. Toy elements are moved upward in the ascending chamber and descend by gravity along a descending path provided in a descending chamber. The manual operation unit incorporates a first clutch mechanism for disconnecting the manual operation unit from the rotary shaft so as to prevent the rotary shaft to turn in another direction that can move the toy elements downward. A second clutch mechanism is provided to disconnect the rotary shaft from the electrical operation unit when the rotary shaft is driven via the manual operation unit.

7 Claims, 5 Drawing Sheets

TOY ASSEMBLY HAVING MOVING TOY ELEMENTS

BACKGROUND OF THE INVENTION (1) Field of the Invention

This invention relates to a toy assembly, more particularly, to a toy assembly having mobile toy elements.

(2) Description of the Related Art

Mobile toys are more appealing to children than immobile toys because children can get more fun out of mobile toys. Conventional mobile toys are generally operated by hand or otherwise by electricity. More specifically, the conventional mobile toys are generally limited to one operation mode so that toys which are designed for manual operation cannot be operated electrically, or the electrically operated toys cannot be operated via manual operation. The so limited toys, particularly, the electrically operated toys, can lose their appeal when there is no power supply or battery. It is therefore desirable to develop mobile toys which can be operated either electrically or manually.

SUMMARY OF THE INVENTION

An object of the invention is to provide a toy assembly which incorporates both manual and electrical operation units that can be actuated selectively to operate mobile toy elements.

According to the present invention, a toy assembly comprises:

- a support having an ascending chamber, at least one descending chamber, an upper passage intercommunicating the tops of the ascending and descending chambers, a lower passages intercommunicating the bottoms of the ascending and descending chambers;
- at least one movable toy element for moving in the ascending chamber, the upper passage, the descending chamber, and the lower passage;
- a rotary shaft rotatably mounted in the ascending chamber and having a helical ridge formed on the periphery thereof to provide an ascending path for the movable toy element, the rotary shaft being rotatable in one direction to move the movable toy element from the lower passage to the upper passage;
- a descending path provided in the descending chamber for the movable toy element to descend by gravity from the upper passage to the lower passage;
- a manual operation unit mounted on the support for driving the rotary shaft, the unit including a first clutch mechanism for disconnecting the rotary shaft from the manual operation unit when the manual operation unit is turned in a direction opposite to said one direction of the rotary shaft;
- an electrical operation unit mounted on the support for driving the rotary shaft in said one direction; and
- a second clutch mechanism provided between the electrical operation unit and the rotary shaft for disengaging the rotary shaft from the electrical operation unit when the manual operation unit is operated.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
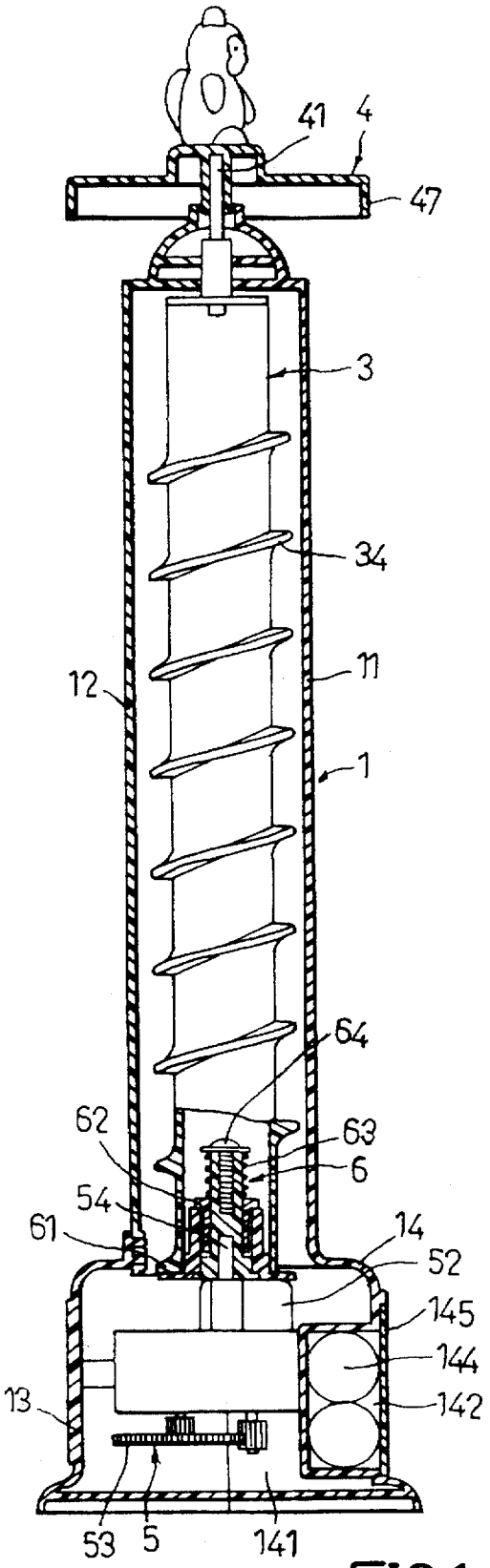
FIG. 1 is a sectional view of the preferred embodiment.
Figure 2:
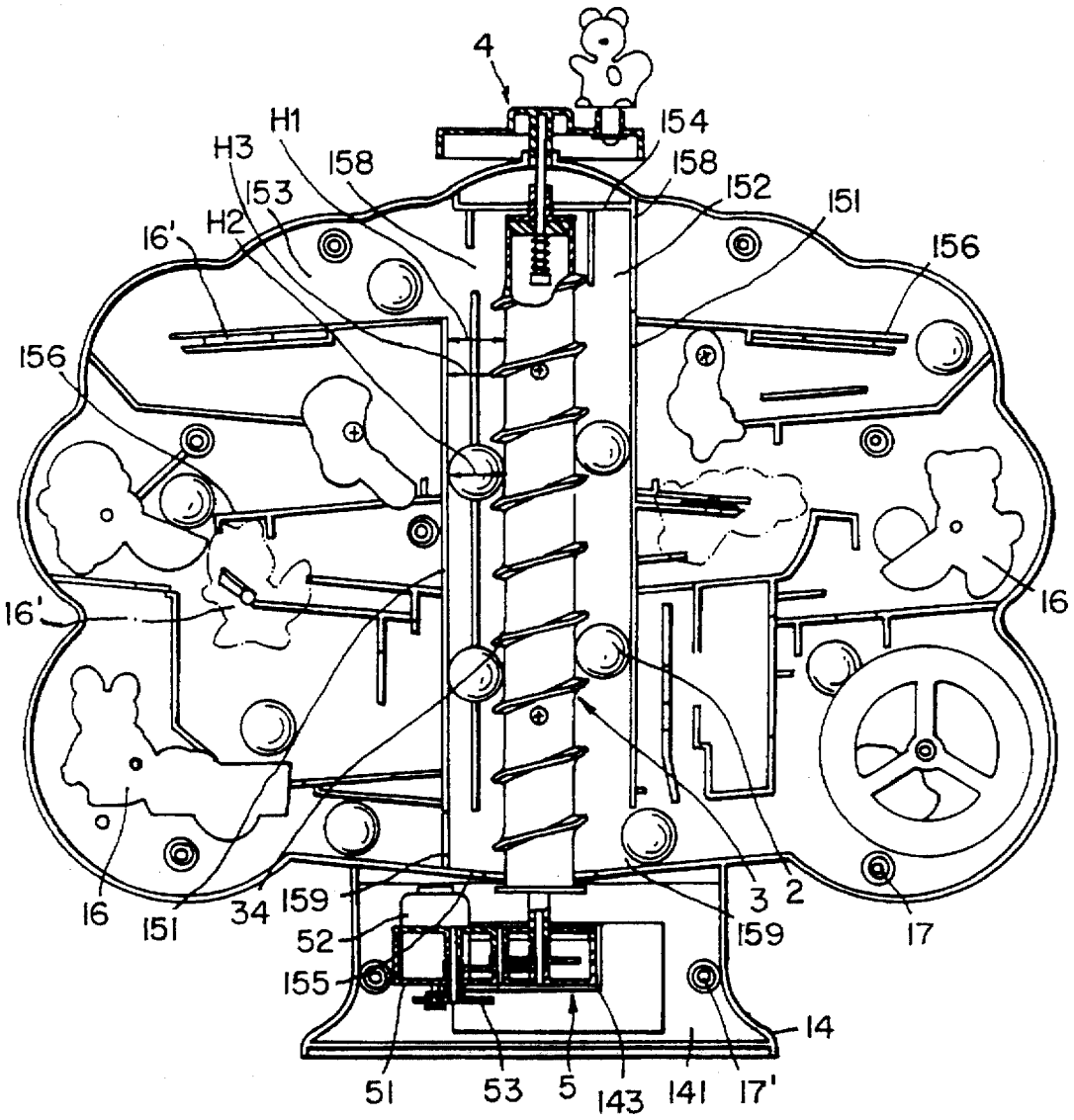
FIG. 2 is a front view of the preferred embodiment with upper and lower front covers being removed.

Referring to FIGS. 1 and 2, the preferred embodiment of the present invention comprises an upright support 1, a plurality of movable toy elements 2, a rotary shaft 3, a manual operation unit 4, an electrical operation unit 5, and a second clutch mechanism 6.

The upright support 1 has a tree-like configuration and comprises a support plate 11, a transparent upper front cover 12, and a bottom front cover 13. The support plate 11 has a base 14 confining a receiving chamber 141 which is opened at the front thereof and a battery chamber 142 which receives batteries 144 and which is closed by a rear battery cover 145. The receiving chamber 141 has a L-shaped support plate 143 to hold a gear box 51 which will be described hereinafter. The support plate 11 further has two vertical partition plates 151 to confine an ascending chamber 152, and two descending chambers 153 on two sides of the ascending chamber 152. Top and bottom plates 154 and 155 are provided at the top and bottom of the ascending chamber 152, and a plurality inclined plates 156 are formed one below the other in each descending chamber 153 to provide a descending path. Upper and lower passages 158 and 159 communicates the ascending chamber 152 with descending chambers 152 and 153.

The transparent upper front cover 12 is fixed to the support plate 11 by via female screws 17 to close the ascending and descending chambers 152 and 153. The bottom front cover 13 is fixed to the base 14 via female screws 17'. A plurality of rocking toy bodies 16 are turnably mounted to the support plate 11, preferably to the upper front cover 12, at intervals along the descending paths while stop members 16' are mounted movably to displace transversely of the descending paths. Movable toy elements, such as, balls 2 are provided to ascend in the ascending chamber 152 and to descend in the descending chambers 153.

Figure 3:
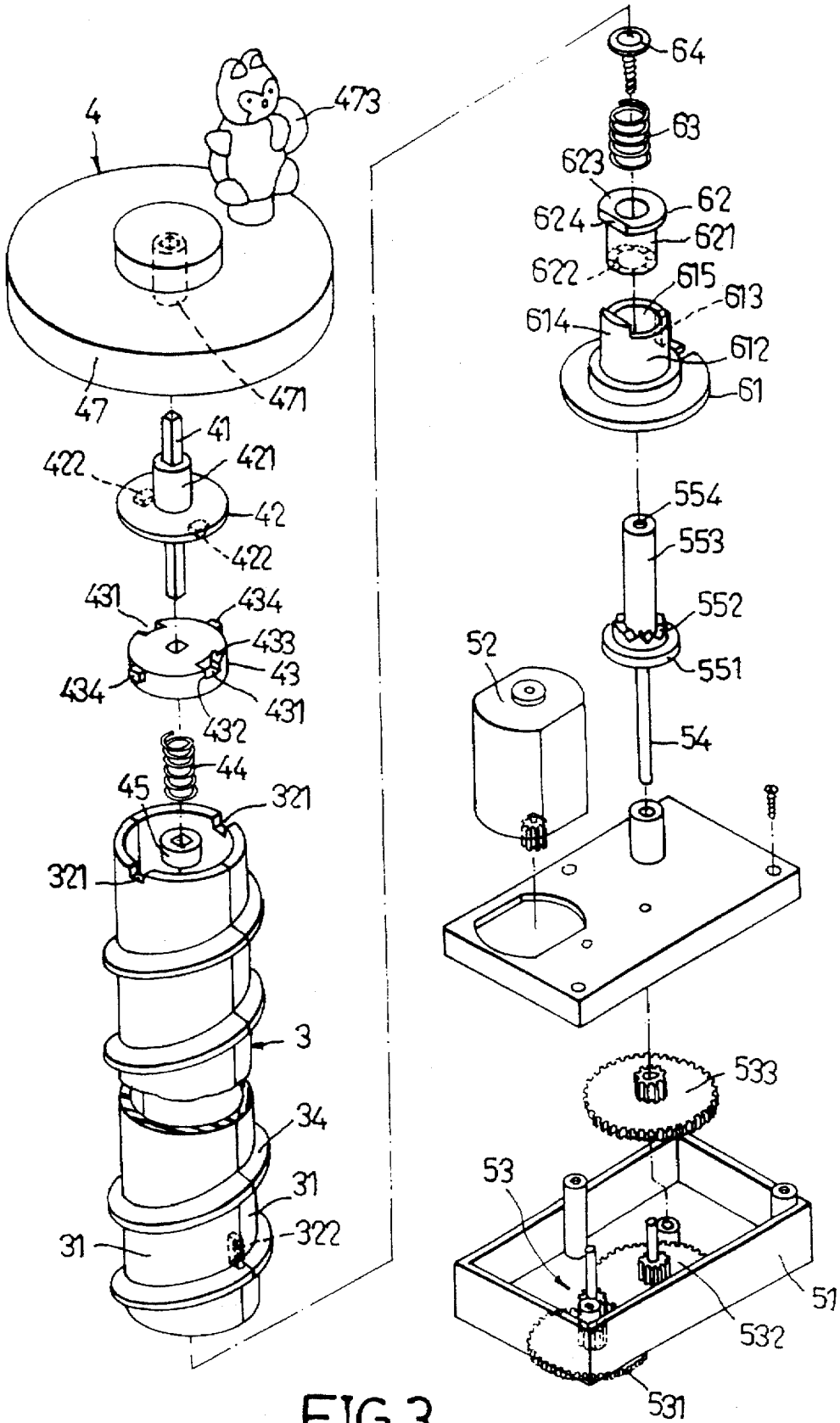
FIG. 3 is an exploded view showing the manual operation unit, the rotary shaft, the electrical operation unit and the second clutch mechanism of the preferred embodiment.

As shown in FIGS. 2 and 3, the rotary shaft 3 is mounted rotatably in the ascending chamber 152 and is constituted of two halves 31 which complement each other to form a cylindrical shaft. A helical ridge 34 is formed around the rotary shaft 3 to form an ascending path. An annular space is confined by the periphery of the rotary shaft 3 and the partition plates 151 with a spacing H1, between the shaft 3 and each partition plate 151, which is greater than the diameter H2 of each ball 2. The spacing H3 between the helical ridge 34 and each partition plate 151 is smaller than the diameter H2 of each ball 2. As such, when the rotary shaft 3 is rotated clockwise, the helical ridge 34 can move each ball 2 upward.

Figure 4:
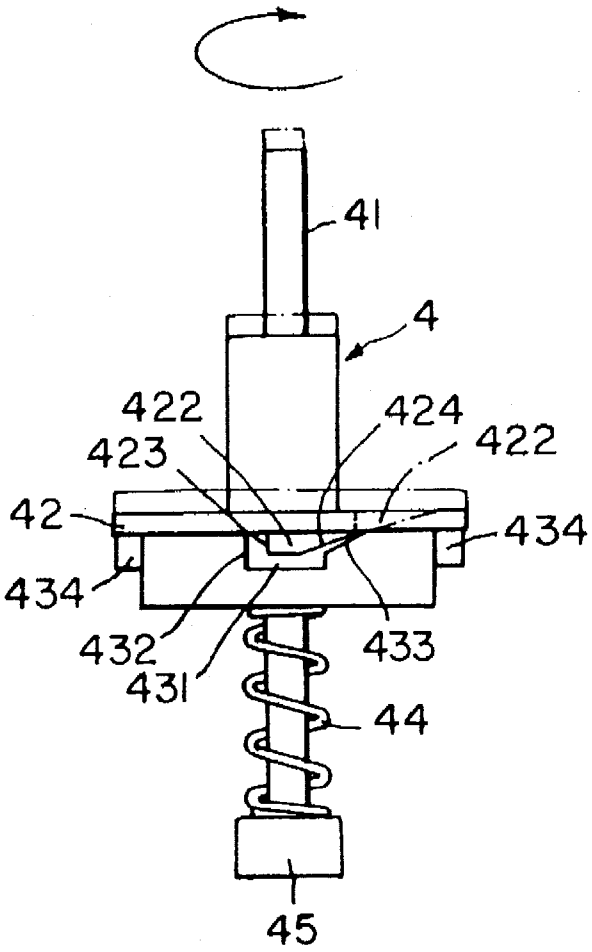
FIG. 4 shows the first clutch mechanism of the manual operation unit.

Referring to FIG. 4 in combination with FIG. 3, the manual operation unit 4 is mounted on the top of the rotary shaft 3 and includes a first driven shaft 41 of square cross-section. The manual operation unit 4 incorporates a first clutch mechanism which comprises a fixed clutch plate 42 that is fixed to the first driven shaft 41 and a movable clutch plate 43 that is movably mounted to the first driven shaft 41. A spring 44 is provided between an end block 45 and the movable clutch plate 43 to urge the movable clutch plate 43 against the fixed clutch plate 42. The fixed clutch plate 42 is formed with cam projections 422 each of which has a push face 423 and a slide face 424 wherein the push face 423 is at the forward position of the clockwise direction of the slide face 424. The movable clutch plate 43 has two concavities 431 for engaging the cam projections 422 respectively. Each concavity 431 has an abutment face 432 to engage the push face 423 of the respective projection 422 and an inclined face 433. The movable clutch member 43 further has two diametrically opposing lugs 434 which are spaced angularly from the respective concavities 431.

When the movable clutch plate 43 is inserted into the top open end of the rotary shaft 3 with the lugs 434 being engaged in notches 321 which are formed at the top open end of the rotary shaft 3, the first driven shaft 41 is connected to the rotary shaft 3. The first driven shaft 41 is mounted rotatably to the top plate 154 of the support plate 11 by inserting the tubular part 421 of the fixed clutch plate 42 into a slot of the top plate 154 of the support plate 11, as shown in FIG. 2. The first driven shaft 41 extends outwardly of the top of the support plate 11 and is connected to a rotary member 47 which has a sleeve 471 to receive the top end of the first driven shaft 41. An animal-shaped handle 473 is formed on the top of the rotary member 47.

Figure 5:
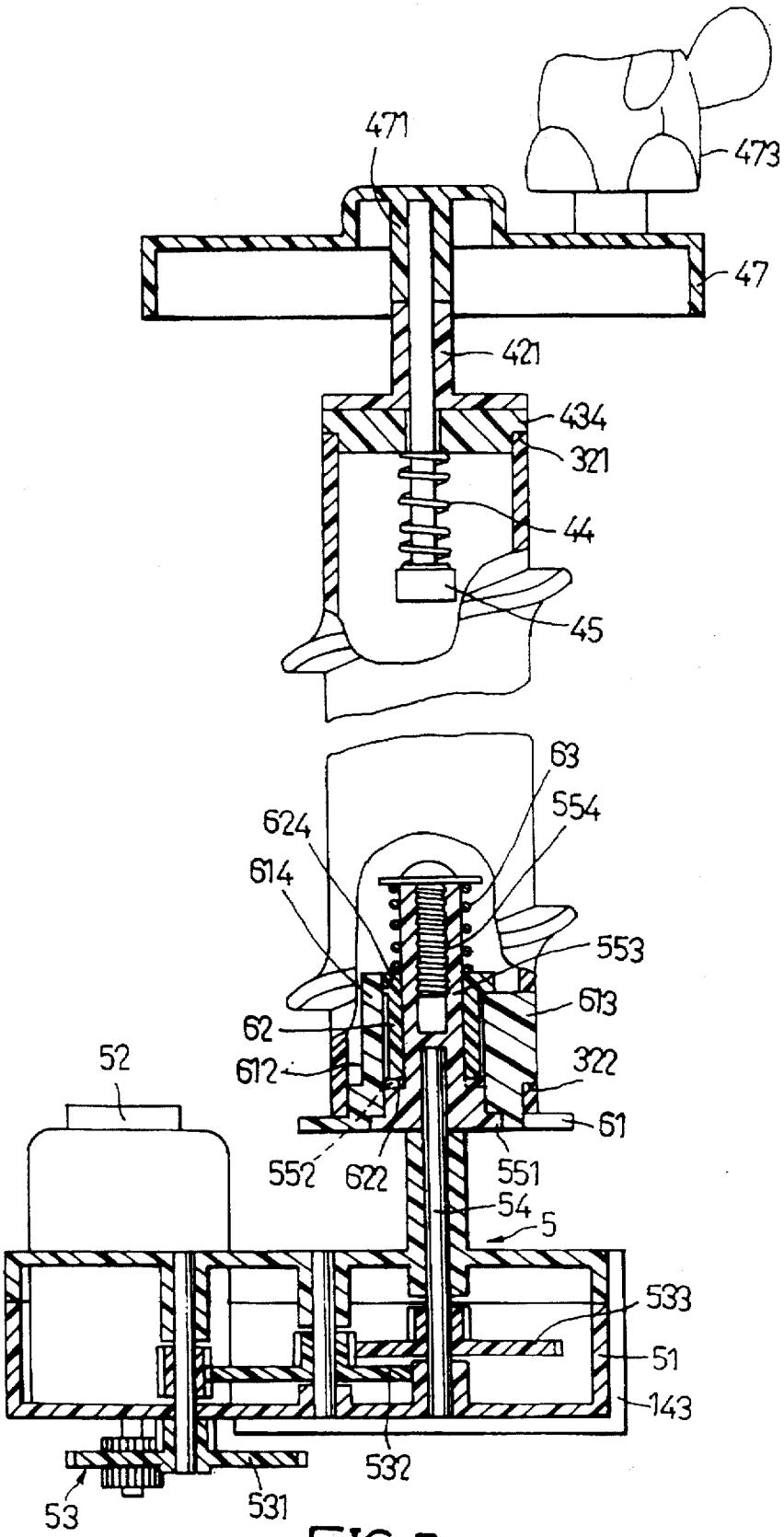
FIG. 5 is a partially sectioned view showing the manual operation unit, the rotary shaft, the electrical operation unit and the second clutch mechanism of the preferred embodiment.

Referring to FIG. 5 in combination with FIG. 3, the electrical operation unit 5 comprises a speed reducing gear assembly 53 provided in a gear box 51 which is mounted to a support plate 143 in the receiving chamber 141 of the base 14. A motor 52 is mounted on the gear box 51. The gear assembly 53 includes a first gear 531 in connection with the motor 52, a second gear 532 connected to the first gear 531, and a third gear 533 engaging the second gear 532. The third gear 533 is mounted to a second driven shaft 54 for simultaneous rotation. An extension 553 of the second driven shaft 54 extends outwardly of the top of the gear box 51.

A seat plate 61 is provided to cover the bottom open end of the rotary shaft 3 and has a cylindrical insert 612 extending into the rotary shaft 3. The seat plate 61 is greater in diameter than the rotary shaft 3, and the cylindrical insert 612 has a locking member 613 which extends radially outward to engage a slot 322 provided at the bottom part of the rotary shaft 3. The second clutch mechanism 6 is mounted to the extension 553 of the second driven shaft 54 and includes a fixed clutch member 551 and a movable clutch member 62. The fixed clutch member 551 has a plurality of annularly arranged clutch teeth 552 and is fixed to the extension 553 of the second driven shaft 54. The cylindrical part 621 of the movable clutch member 62 is received in a through-hole 615 of the cylindrical insert 612 and has a plurality of annularly arranged shallow recesses 622 to engage the clutch teeth 552 of the fixed clutch member 551. An enlarged top flange 623 is formed at the top of the movable clutch member 62 and has a cutout part 624 at one side thereof to abut an abutment member 614 which projects upward from the cylindrical insert 612 of the seat plate 61. A spring 63 is sleeved onto the extension 553 of the second driven shaft 54, and a locking screw 64 is threaded into a bore 554 of the extension 553 to lock the spring 63 against the movable clutch member 62, thereby urging the movable clutch member 62 to the fixed clutch member 551 and interengaging the shallow recesses 622 of the movable clutch member 62 and the clutch teeth 552 of the fixed clutch member 551.

As described above, in assembly, the electrical operation unit 5 and the second clutch mechanism 6 is connected to the bottom of the rotary shaft 3, and the manual operation unit 4 is connected to the top of the rotary shaft 3. As shown in FIGS. 2 and 4, when the rotary member 47 is rotated by turning the handle 473 clockwise, the cam projections 422 push the movable clutch plate 43 via the push faces 423, thereby rotating the rotary shaft 3 clockwise. As the rotary shaft 3 rotates clockwise, the balls 2 ascend along the helical path of the rotary shaft 3 and leaves for the descending chambers 153 through upper passages 158. After the balls 2 descend by gravity along the paths provided by the inclined plates 156, they enter again the ascending chamber 152 via lower passages 159.

During manual operation, the rotary shaft 3 is disconnected from the second driven shaft 54 via the second clutch mechanism 6 because the second driven shaft 54 is immovable due to the inoperative motor. Specifically, when the rotary shaft 3 is turned clockwise, the seat plate 61, which is coupled to the bottom part of the rotary shaft 3, is rotated clockwise so that the abutment member 614 of the seat plate 61 pushes and turns the movable clutch member 62. In this situation, although the recesses 622 of the movable clutch member 62 engage the clutch teeth 552 of the fixed clutch member 551, since the fixed clutch member 551 is immobilized and since the recesses 622 are shallow, the manual turning of the rotary shaft 3 can move the movable clutch member 62 against the action of the spring 63 and cause the recesses 622 to disengage from the clutch teeth 552 of the fixed clutch member 551.

The first clutch mechanism functions to disconnect the manual operation unit 4 from the rotary shaft 3 when the rotary member 47 is turned counterclockwise because the counterclockwise rotation of the rotary member 47 will cause the balls 2 to undesirably move downward. As shown in FIGS. 4 and 5, when the first driven shaft 41 is turned counterclockwise, since the slide faces 424 of the cam projections 422 is at the forward position of the counterclockwise direction relative to the push faces 423, the slide faces 424 of the cam projections 422 acts on the movable clutch plate 43. Due to the presence of the slide faces 424 in the fixed clutch plate 42 and the inclined faces 433 in the movable clutch plate 43, the movable clutch plate 43 does not engage the fixed clutch plate 42 when the rotary member 47 is turned counterclockwise.

Referring to FIGS. 2 and 5, when the electrical operation unit 5 is actuated, the motor 52 is turned, and the output rotation of the motor 52 is transmitted to the second driven shaft 54 via the gear assembly 53. As the driven shaft 54 rotates, the fixed clutch member 551, which engages the movable clutch member 62, drives the movable clutch member 62. The movable clutch member 62 in turn drives the seat plate 61 and the rotary shaft 3 in a clockwise direction.

With this invention thus explained, it is apparent that numerous modifications and variations can be made without departing from the scope and spirit of this invention, it is therefore intended that this invention be limited only as indicated in the appended claims.

What I claim is:

1. A toy assembly comprising:

a support having an ascending chamber, at least one descending chamber, an upper passage intercommunicating the tops of said ascending and descending chambers, a lower passage intercommunicating the bottoms of said ascending and descending chambers;

at least one movable toy element which is movable in said ascending chamber, said upper passage, said descending chamber, and said lower passage;

a rotary shaft rotatably mounted in said ascending chamber and having a helical ridge formed on the periphery thereof to provide an ascending path for said movable toy element, said rotary shaft being rotatable in one direction to move said movable toy element from said lower passage to said upper passage;

a descending path provided in said descending chamber for said movable toy element to descend by gravity from said upper passage to said lower passage;

a manual operation unit connected to the top of said rotary shaft for driving said rotary shaft, said unit including a first clutch mechanism for disconnecting said rotary shaft from said manual operation unit when said manual operation unit is turned in a direction opposite to said one direction of said rotary shaft;

an electrical operation unit mounted on said support and connected to the bottom of said rotary shaft for driving said rotary shaft in said one direction; and a second clutch mechanism provided between said electrical operation unit and said rotary shaft for disengaging said rotary shaft from said electrical operation unit when said manual operation mechanism is operated.

2. A toy assembly as claimed in claim 1, wherein said manual operation unit includes a manually operable rotary member provided at the top of said support to be connected to the top of said rotary shaft, and a first driven shaft connected to said rotary member, said first clutch mechanism including a fixed clutch plate coaxially coupled to said first driven shaft, a movable clutch plate which is connected to said rotary shaft and which is mounted movably on said first driven shaft for being engaged with or disengaged from said fixed clutch plate, and a cam mechanism provided between said fixed and movable clutch plates for camming said movable clutch plate to disengage from said fixed clutch plate when said rotary shaft is turned in a direction opposite to said one direction.

3. A toy assembly as claimed in claim 2, wherein said first cam includes a cam projection formed on said fixed clutch plate, a concavity formed on said movable clutch plate to receive said cam projection, said concavity having an abutment face to be pushed by said cam projection when said manually operable rotary member rotates in said one direction of said rotary shaft, and an inclined face to be cammed by said cam projection when said manually operable rotary member rotates in a direction opposite to said one direction of said rotary shaft.

4. A toy assembly as claimed in claim 1, wherein said rotary shaft is hollow and has a covering seat plate at the bottom of said rotary shaft for simultaneous rotation, and a cylindrical insert integral with said covering seat plate and extending into said rotary shaft.

5. A toy assembly as claimed in claim 4, wherein said electrical operation unit has a second driven shaft to be operated electrically and extending into said cylindrical insert, said second clutch mechanism comprising a fixed clutch member which is fixed to said second driven shaft and which has clutch teeth annularly disposed around said second driven shaft, a movable clutch member movably mounted to said second driven shaft and engaged with said cylindrical insert for simultaneous rotation, said movable clutch member having a plurality of annularly arranged recesses to releaseably engage said clutch teeth, said recesses being capable of disengaging from said teeth when said second driven shaft is inoperative.

6. A toy assembly as claimed in claim 1, wherein said support has a tree-like shape and includes two descending chambers on two sides of said ascending chamber, said support further having a receiving chamber below said ascending chamber to receive said electrical operation unit.

7. A toy assembly as claimed in claim 1, wherein said descending chamber has a plurality of inclined plates which are arranged one below the other to provide said descending path.

* * * * *